US006408814B2

(12) United States Patent
Shigemori

(10) Patent No.: US 6,408,814 B2
(45) **Date of Patent: *Jun. 25, 2002**

(54) FOUR-CYCLE INTERNAL COMBUSTION ENGINE

(76) Inventor: Yoshiharu Shigemori, 2-26, Habikino 6-chome, Habikino-shi, Osaka-fu (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/456,965

(22) Filed: Dec. 7, 1999

(51) Int. Cl.[7] ..... F02B 75/32
(52) U.S. Cl. ..... 123/197.4; 123/78 E; 123/78 F
(58) Field of Search ..... 123/197.1, 197.4, 123/197.3, 48 B, 78 E, 78 F

(56) References Cited

U.S. PATENT DOCUMENTS 4,152,955 A * 5/1979 McWhorter ..... 74/602
5,170,757 A * 12/1992 Gamache ..... 123/197.4
5,425,334 A * 6/1995 Yonehara ..... 123/197.1
5,908,014 A * 6/1999 Leithinger ..... 123/78 F
5,927,236 A * 7/1999 Gonzalez ..... 123/78 F

* cited by examiner

*Primary Examiner*—Tony M. Argenbright
*Assistant Examiner*—Hai Huynh
(74) *Attorney, Agent, or Firm*—John F. A. Earley; John F. A. Earley, III; Harding, Earley, Follmer & Frailey

(57) ABSTRACT

A four-cycle internal combustion engine having a piston reciprocably movable within a cylinder, a crankshaft, a rod connecting the piston to the crankshaft and means arranged between the rod and the crankshaft to vary the stroke of the piston, said means for varying the stroke comprising an internal gear, an external gear and an eccentric member, characterized in that the eccentric distance of the crankpin, the radius of the pitch circle of the external gear and the radius of the pitch circle of the internal gear are in the ratio of one to two to three.

3 Claims, 3 Drawing Sheets

FOUR-CYCLE INTERNAL COMBUSTION ENGINE

FIELD OF THE INVENTION

This invention relates to four-cycle internal combustion engines.

BACK GROUND OF THE INVENTION

The admission stroke and the explosion stroke of conventional four-cycle internal combustion engines are the same, due to the construction of the engines, and at the end of the explosion stroke, the engines exhaust combusion gases, which still have considerable energy of compression, as exhaust gases to the atomosphere.

SUMMARY OF THE INVENTION

An object of the present invetion is to provide a four-cycle internal combustion engine the explosion stroke of which is longer than the admission stroke.

Another object of the invention is to provide a four-cycle internal combustion engine capable of utilizing compression energy of exhaust gases so that the efficiency of the engine may be increased, while cleaning exhaust gases.

To accomplish these purposes, this invention provides a four-cycle internal combustion engine having a piston 70 reciprocably movable within a cylinder 80, a crankshaft 10, a rod 60 connecting the piston 70 to the crankshaft 10 and means arranged between the rod 60 and the crankshaft 10 to vary the stroke of the piston 70, said means for varying the stroke comprising an internal gear 20 fixed on the frame 90 of the engine, an external gear 30 engaged with the internal gear 20 as rotatably supported on the crankpin 12 of the crankshaft 10 an eccentric member fixed eccentrically to the crankpin 12 on the external gear 30, characterized in that the eccentric distance of the crankpin 12, the radius of the pitch circle of the external gear 30 and the radius of the pitch circle of the internal gear 20 are in the ratio of one to two to three.

DESCRIPTION OF THE PREFERRED EMBODIMENT

Figure 1:
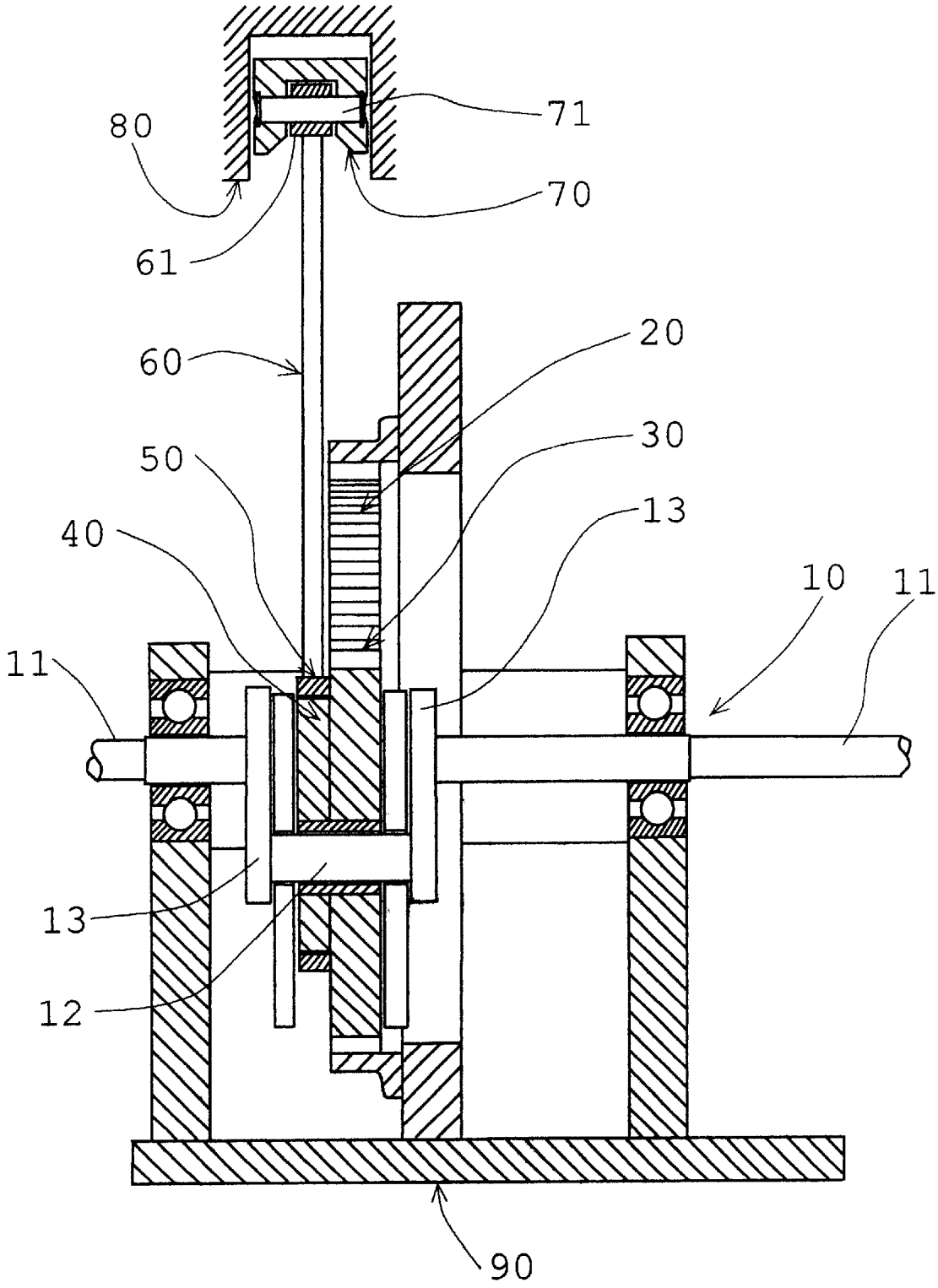
FIG. 1 is a schematic cross-sectional view of a portion of an engine according to an embodiment of the invention.
Figure 2:
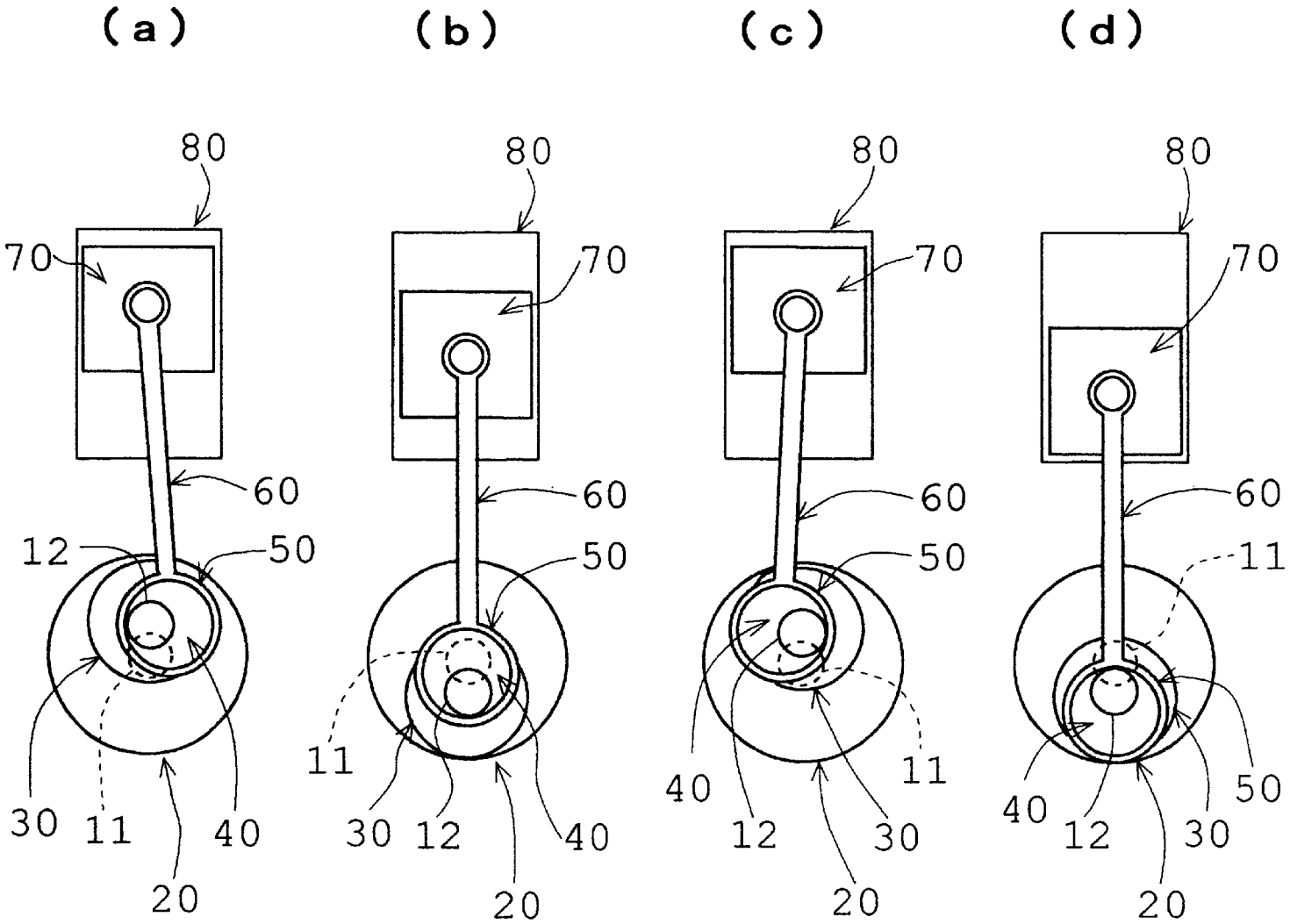
FIGS. 2(*a*) to 2(*d*) are schematic views showing the position of components of the engine shown in FIG. 1.

A four-cycle internal combustion engine of an embodiment of the invention is schematically illustrated in FIG. 1 and FIGS. 2(*a*) to 2(*d*).

The four-cycle internal combustion engine comprises a crankshaft 10, an internal gear 20, an external gear 30, a circular eccentric cam (an eccentric member) 40, a ring 50, a rod 60, a piston 70 and a cylinder 80.

The crank shaft 10 has a crankpin 12 and crank arms 13 and 13.

The internal gear 20 is fixed concentrically to the crankshaft 10 on the frame 90, and it is arranged so that it may not obstruct the movement of the crankshaft 10.

The external gear 30 is rotatably supported on the crankpin 12, and it is engaged with the internal gear 20.

The circular eccentric cam 40 is formed in a body with the external gear 30.

The ring 50 is pivotably engaged with a peripheral surface of the circular eccentric cam 40, and it is connected to the rod 60.

The rod 60 is pivotably connected to a piston pin 71 of the piston 70.

The piston 70 is reciprocably movable within the cylinder 80.

Besides, the eccentric distance of the crankpin 12, the radius of the pitch circle of the external gear 30 and the radius of the pitch circle of the internal gear 20 are in the ratio of one to two to three.

Operation of the four-cycle internal combustion engine according to the invention is explained hereinafter.

FIGS. 2(*a*) to 2(*d*) show the positon of components of the engine, especially, the crank pin 12, the external gear 30, the circular eccentric cam 40, the rod 60 and the piston 70 at the beginning or the end of each stroke.

Namely, FIG. 2(*a*) shows the position at the end of the exhaust stroke and the beginning of the admission stroke, and FIG. 2(*b*) shows the position at the end of the admission stroke or the beginning of the compression stroke, and FIG. 2(*c*) shows the position at the end of the compression stroke or the beginning of the explosion stroke, and FIG. 2(*d*) shows the position at the end of the explosion stroke or the beginning of the exhaust stroke.

When the engine is operated, during the admission stroke, the crankpin 12, the external gear 30, the rod 60 and the piston 70 are moved from the position shown in FIG. 2(*a*) to the position shown in FIG. 2(*b*), and during the compression stroke, they are moved from the position shown in FIG. 2(*b*) to the position shown in FIG. 2(*c*), and during the explosion stroke, they are moved from the position shown in FIG. 2(*c*) to the position shown in FIG. 2(*d*), and during the exhaust stroke, they are moved from the position shown in FIG. 2(*d*) to the position shown in FIG. 2(*a*).

As FIGS. 2(*a*) to 2(*d*) show, when the crank shaft 10 is rotated two times during four cycles, the external gear 30 is rotated three times in the opposite direction. This enables the external gear 30 to come back to the first position every four-cycle.

Accordingly, it is possible for the explosion stroke, for the instance, to be elongated by a distance almost two times of the eccentric distance of the circular eccentric cam 40.

Figure 3:
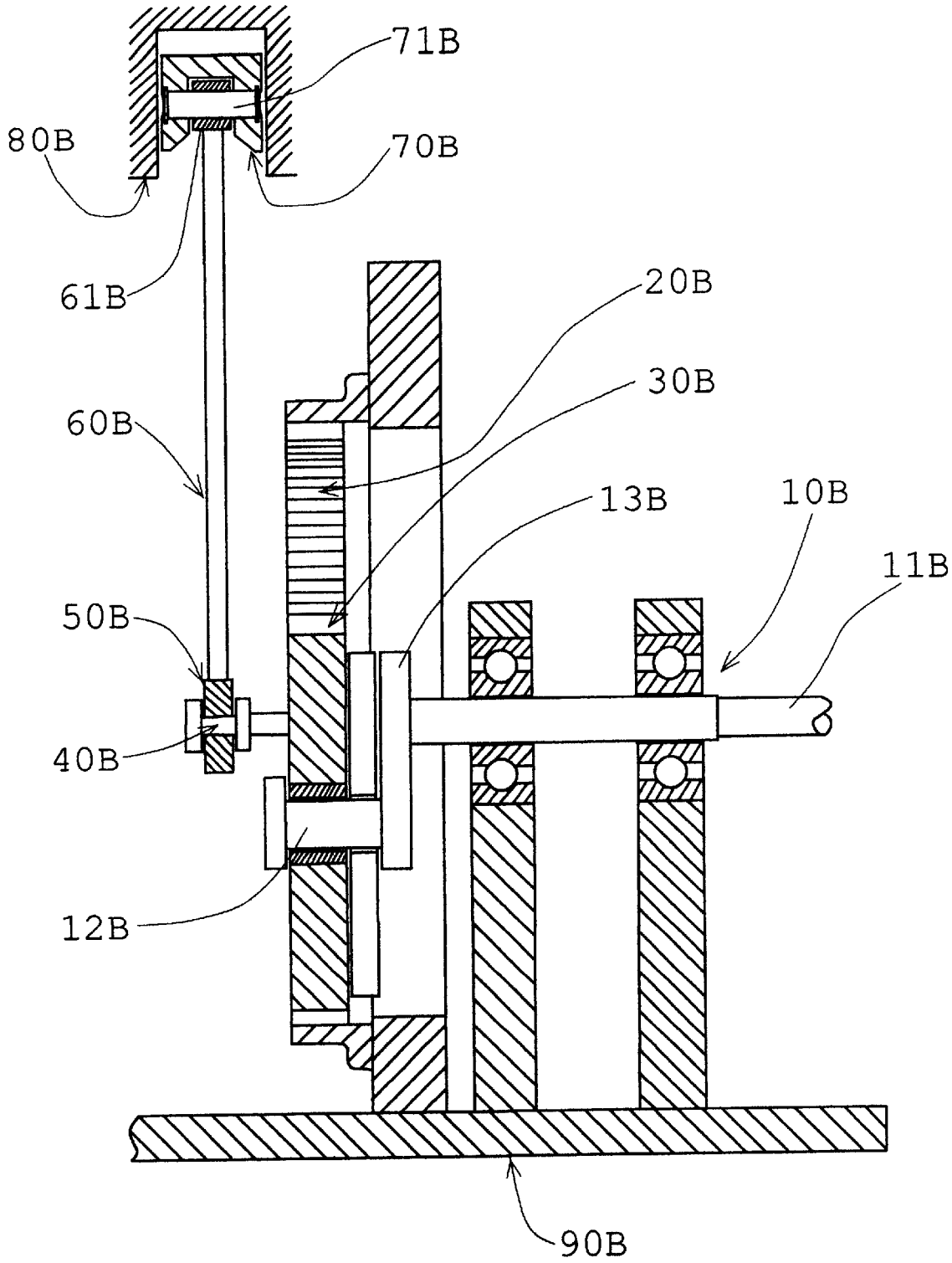
FIG. 3 is a schematic cross-sectional view of a portion of an engine according to another embodiment of the invention.

The engine according to another embodiment is schematically shown in FIG. 3.

The engine has almost same construction as the one shown in FIG. 1, except for the eccentric member 40B being a journal, and then, detailed explanations are omitted.

In the four-cycle internal combustion engine according to the invention, the explosion stroke can be longer than the admission stroke. Accordingly, energy lost in exhaust gases is decreased to that extent, and a great part of compression energy of combustion gases is effectively utilized, and the efficiency of the engine is increased, and exhaust gases are cleaned.

Furthermore, this invention can contribute especially to the heightenning of the efficiency of supercharging engines.

I claim:

1. A four-cycle internal combustion engine having a piston reciprocably movable within a cylinder, a crankshaft, a rod connecting the piston to the crankshaft and means arranged between the rod and the crankshaft to vary the stroke of the piston, said means for varying the stroke comprising an internal gear fixed on the frame of the engine, an external gear engaged with the internal gear as rotatably supported on the crankpin of the crankshaft and an eccentric member fixed eccentrically to the crankpin on the external gear, characterized in that the eccentiric distance of the crankpin, the radius of the pitch circle of the external gear and the radius of the pitch circle of the internal gear are in the ratio of one to two to three.

2. A four-cycle internal combustion engine as in claim 1, wherein the eccentric member is a circular cam.

3. A four-cycle internal combustion engine as in claim 1, wherein the eccentric member is a journal.

* * * * *